US010137491B2

(12) United States Patent
Ishizuka et al.

(10) Patent No.: US 10,137,491 B2
(45) Date of Patent: Nov. 27, 2018

(54) FORMING DEVICE AND FORMING METHOD

(71) Applicant: SUMITOMO HEAVY INDUSTRIES, LTD., Tokyo (JP)

(72) Inventors: Masayuki Ishizuka, Niihama (JP); Masayuki Saika, Niihama (JP); Norieda Ueno, Tokyo (JP); Takashi Komatsu, Oyama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/617,454

(22) Filed: Jun. 8, 2017

(65) Prior Publication Data

US 2017/0266710 A1 Sep. 21, 2017

Related U.S. Application Data

(63) Continuation of application No. PCT/JP2015/084022, filed on Dec. 3, 2015.

(30) Foreign Application Priority Data

Dec. 11, 2014 (JP) ..... 2014-250509

(51) Int. Cl.
*B21D 26/035* (2011.01)
*B21D 26/047* (2011.01)

(52) U.S. Cl.
CPC ..... *B21D 26/035* (2013.01); *B21D 26/047* (2013.01)

(58) Field of Classification Search
CPC .. B21D 26/033; B21D 26/041; B21D 26/043; B21D 26/047; B21D 26/035
See application file for complete search history.

(56) References Cited

U.S. PATENT DOCUMENTS 5,070,717 A 12/1991 Boyd et al.
2010/0186473 A1* 7/2010 Mizumura ..... B21D 22/025 72/60

FOREIGN PATENT DOCUMENTS

JP 2006061944 A 3/2006
JP 2009220141 A 10/2009
(Continued)

OTHER PUBLICATIONS

International Search Report application No. PCT/JP2015/084022 dated Mar. 1, 2016.
(Continued)

*Primary Examiner* — Debra Sullivan
(74) *Attorney, Agent, or Firm* — Squire Patton Boggs (US) LLP

(57) ABSTRACT

By the control of a controller, a gas is supplied into a metal pipe material from a gas supply part so as to expand a part of the metal pipe material in sub-cavity parts, and then a driving mechanism is driven such that expanded parts of the metal pipe material are pressed by an upper die and a lower die to form flange parts. In addition, by the control of the controller, a gas is supplied into the metal pipe material after the formation of the flange parts from the gas supply part so as to form a pipe part in a main cavity part. In this manner, the controller controls the gas supply part and the driving mechanism, and thus flange parts and a pipe part having a desired shape can be easily formed.

4 Claims, 8 Drawing Sheets

(56) References Cited

FOREIGN PATENT DOCUMENTS

| | | | |
|---|---|---|---|
| JP | 2012000654 | A | 1/2012 |
| WO | 2009/014233 | A1 | 1/2009 |

OTHER PUBLICATIONS

International Preliminary Report on Patentability and Written Opinion International application No. PCT/JP2015/084022 dated Jun. 13, 2017.
European Search Report dated Jul. 25, 2018, issued in corresponding EP Application No. 15867703.9.

* cited by examiner

FORMING DEVICE AND FORMING METHOD

RELATED APPLICATIONS

Priority is claimed to Japanese Patent Application No. 2014-250509, filed Dec. 11, 2014, and International Patent Application No. PCT/JP2015/084022, the entire content of each of which is incorporated herein by reference.

BACKGROUND

Technical Field

Certain embodiments of the present invention relate to a forming device and a forming method.

Description of Related Art

Forming devices that form a metal pipe having a pipe part and a flange part by expansion with the supply of a gas into a heated metal pipe material have been known. For example, a forming device disclosed in the related art is provided with a pair of upper and lower dies, a gas supply part that supplies a gas into a metal pipe material held between the upper die and the lower die, a first cavity part (main cavity) that is formed by combining the upper die and the lower die together to form a pipe part, and a second cavity part (sub-cavity) that communicates with the first cavity part to form a flange part. In this forming device, the pipe part and the flange part can be simultaneously formed by closing the dies and expanding the metal pipe material with the supply of a gas into the metal pipe material.

SUMMARY

A forming device that forms a metal pipe having a pipe part and a flange part according to an aspect of the invention includes: a pair of a first die and a second die; a driving mechanism that moves at least one of the first die and the second die in a direction in which the dies are combined together; a gas supply part that supplies a gas into a metal pipe material held and heated between the first die and the second die; and a controller that controls driving of the driving mechanism and gas supply of the gas supply part, the first die and the second die configure a first cavity part for forming the pipe part and a second cavity part, communicating with the first cavity part, for forming the flange part, and the controller causes the gas supply part to supply a gas into the metal pipe material such that a part of the metal pipe material is expanded in the second cavity part, drives the driving mechanism such that the expanded part of the metal pipe material is pressed by the first die and the second die and the flange part is formed, and causes the gas supply part to supply a gas into the metal pipe material after the formation of the flange part such that the pipe part is formed in the first cavity part.

A forming method for forming a metal pipe having a pipe part and a flange part according to another aspect of the invention includes: preparing a heated metal pipe material between a first die and a second die; moving at least one of the first die and the second die in a direction in which the dies are combined together to form a first cavity part for forming the pipe part and a second cavity part, communicating with the first cavity part, for forming the flange part between the first die and the second die; supplying a gas into the metal pipe material by a gas supply part to expand a part of the metal pipe material in the second cavity part; moving at least one of the first die and the second die in a direction in which the dies are combined together to press the expanded part of the metal pipe material by the first die and the second die and form the flange part; and supplying a gas into the metal pipe material after the formation of the flange part by the gas supply part to form the pipe part in the first cavity part.

BRIEF DESCRIPTION OF THE DRAWINGS

FIG. 3A is a view showing a state in which a metal pipe material is held by the electrodes. FIG. 3B is a diagram showing a state in which a sealing member is brought into contact with the electrodes. FIG. 3C is a front view of the electrodes.

FIG. 4A is a diagram showing a state in which a metal pipe material is set in the die. FIG. 4B is a diagram showing a state in which the metal pipe material is held by the electrodes.

DETAILED DESCRIPTION

Figure 1:
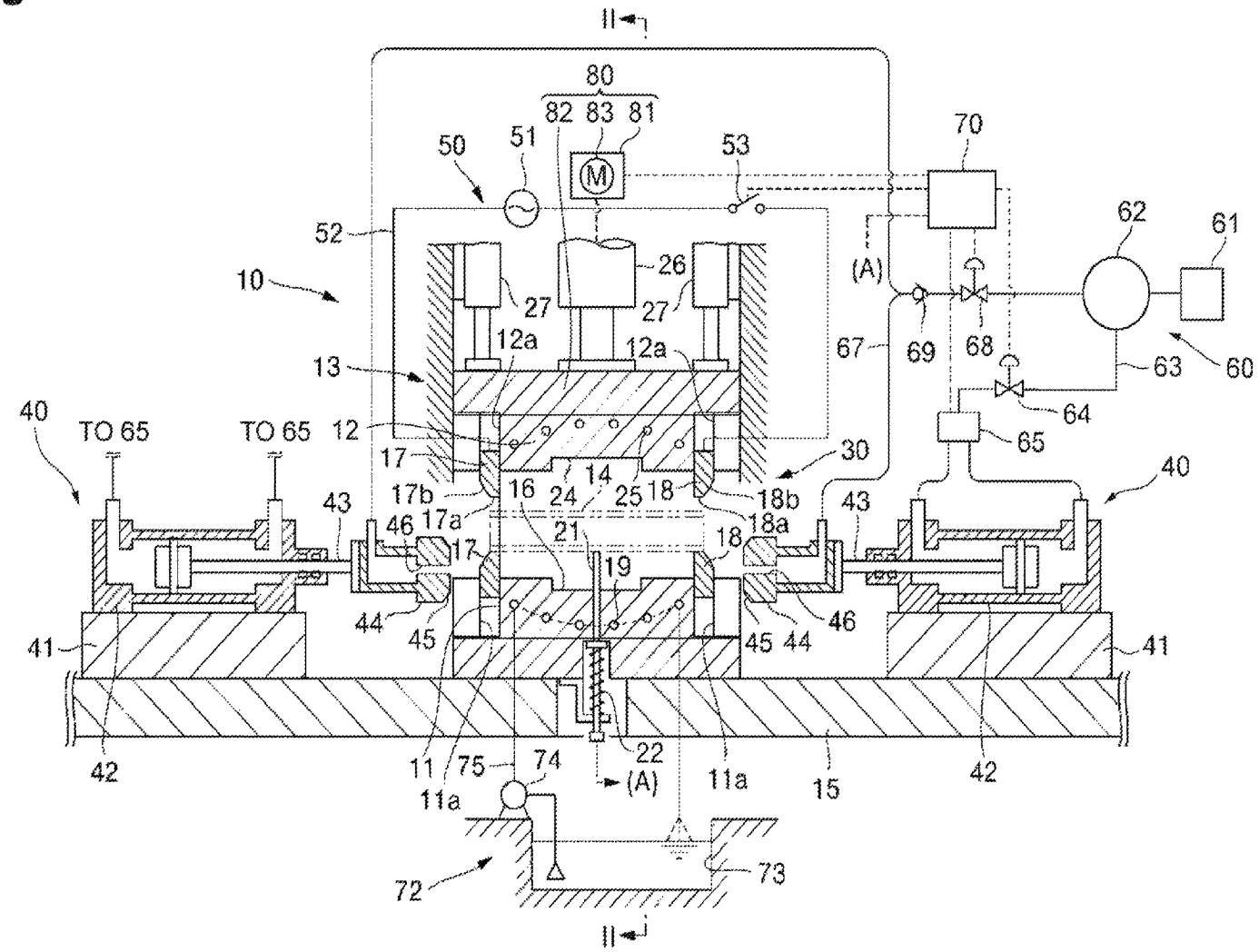
FIG. 1 is a schematic diagram of a configuration of a forming device.

However, when the pipe part and the flange part are simultaneously formed in the forming device, a part of the metal pipe material that becomes the flange part may be excessively expanded and the size of the flange part may be excessively increased. In this case, the flange part may have an extremely small thickness and bend, and there is a problem in that a flange part having a desired shape cannot be obtained.

In a case where a gas is supplied into the metal pipe material such that a part of the metal pipe material that becomes the flange part is not excessively expanded, the pipe part may not be sufficiently expanded, and there is a problem in that a metal pipe having a desired shape cannot be obtained.

According to an embodiment of the present invention, there is provided a forming device and a forming method capable of easily forming a flange part and a pipe part having a desired shape.

According to such a forming device, by the control of the controller, a gas can be supplied into the metal pipe material from the gas supply part so as to expand a part of the metal pipe material in the second cavity part, and then the driving mechanism can be driven such that the expanded part of the metal pipe material is pressed by the first die and the second die to form a flange part. In addition, by the control of the controller, a gas can be supplied into the metal pipe material after the formation of the flange part from the gas supply part so as to forma pipe part in the first cavity part. In this manner, the controller controls the gas supply part and the driving mechanism so as to separately form the flange part and the pipe part of the metal pipe, and thus a flange part and a pipe part having a desired shape can be easily formed.

Here, a pressure of the gas when a part of the metal pipe material is expanded in the second cavity part may be lower than a pressure of the gas when the pipe part is formed in the first cavity part. In this case, a flange part can be formed into a desired size with the low-pressure gas, and a pipe part having a desired shape can be formed with the high-pressure gas regardless of the flange part. Therefore, a flange part and a pipe part having a desired shape can be more easily formed.

According to such a forming method, the gas supply part supplies a gas into the metal pipe material, and thus a part of the metal pipe material is expanded in the second cavity part. In addition, at least one of the first die and the second die is moved in a direction in which the dies are combined together, and thus the expanded part of the metal pipe material can be pressed by the first die and the second die, and a flange part can be formed. Then, the gas supply part supplies a gas into the metal pipe material after the formation of the flange part, and thus a pipe part can be formed in the first cavity part. In this manner, the flange part and the pipe part of the metal pipe are separately formed, and thus a flange part and a pipe part having a desired shape can be easily formed.

Here, a pressure of the gas when a part of the metal pipe material is expanded in the second cavity part may be lower than a pressure of the gas when the pipe part is formed in the first cavity part. In this case, a flange part can be formed into a desired size with the low-pressure gas, and a pipe part having a desired shape can be formed with the high-pressure gas regardless of the flange part. Therefore, a flange part and a pipe part having a desired shape can be more easily formed.

According to an aspect of the invention, it is possible to provide a forming device and a forming method capable of easily forming a flange part and a pipe part having a desired shape.

Hereinafter, preferable embodiments of a forming device and a forming method according to an aspect of the invention will be described with reference to the drawings. In the drawings, the same or similar parts will be denoted by the same reference signs, and overlapping description will be omitted.

Configuration of Forming Device

FIG. 1 is a schematic diagram of a configuration of a forming device. As shown in FIG. 1, a forming device 10 that forms a metal pipe 100 (see FIG. 5) is provided with a blow forming die 13 that includes a pair of an upper die (first die) 12 and a lower die (second die) 11, a driving mechanism 80 that moves at least one of the upper die 12 and the lower die 11, a pipe holding mechanism (holding unit) 30 that holds a metal pipe material 14 between the upper die 12 and the lower die 11, a heating mechanism (heater) 50 that energizes the metal pipe material 14 held by the pipe holding mechanism 30 to heat the metal pipe material, a gas supply part 60 for supplying a high-pressure gas (gas) into the metal pipe material 14 held and heated between the upper die 12 and the lower die 11, a pair of gas supply mechanisms 40 for supplying a gas into the metal pipe material 14 held by the pipe holding mechanism 30 from the gas supply part 60, and a water circulation mechanism 72 that forcibly cools the blow forming die 13 with water. In addition, the forming device 10 is provided with a controller 70 that controls driving of the driving mechanism 80, driving of the pipe holding mechanism 30, driving of the heating mechanism 50, and gas supply of the gas supply part 60.

The lower die (second die) 11 is fixed to a large base 15. The lower die 11 is composed of a large steel block and is provided with a cavity (recessed part) 16 in an upper surface thereof. An electrode storage space 11*a* is provided near each of right and left ends (right and left ends in FIG. 1) of the lower die 11. The forming device 10 is provided with a first electrode 17 and a second electrode 18 that are configured to advance or retreat in a vertical direction by an actuator (not shown) in the electrode storage space 11*a*. Recessed grooves 17*a* and 18*a* having a semi-arc shape corresponding to an outer peripheral surface on the lower side of the metal pipe material 14 are formed in upper surfaces of the first electrode 17 and the second electrode 18, respectively (see FIG. 3C), and the metal pipe material 14 can be placed to be well fitted in the recessed grooves 17*a* and 18*a*. In addition, in a front surface of the first electrode 17 (a surface of the die in an outward direction), a tapered recessed surface 17*b* is formed such that the vicinity thereof is recessed at an angle into a tapered shape toward the recessed groove 17*a*, and in a front surface of the second electrode 18 (a surface of the die in an outward direction), a tapered recessed surface 18*b* is formed such that the vicinity thereof is recessed at an angle into a tapered shape toward the recessed groove 18*a*. In addition, a cooling water passage 19 is formed in the lower die 11 and is provided with a thermocouple 21 inserted from the bottom at a substantially center thereof. This thermocouple 21 is supported movably up and down by a spring 22.

The pair of first and second electrodes 17 and 18 positioned in the lower die 11 constitute the pipe holding mechanism 30, and can elevatably support the metal pipe material 14 between the upper die 12 and the lower die 11. The thermocouple 21 is just an example of the temperature measuring unit, and a non-contact temperature sensor such as a radiation thermometer or an optical thermometer may be provided. A configuration without the temperature measuring unit may also be employed if the correlation between the energization time and the temperature can be obtained.

The upper die (first die) 12 is a large steel block that is provided with a cavity (recessed part) 24 in a lower surface thereof and a cooling water passage 25 built therein. An upper end part of the upper die 12 is fixed to a slide 82. The slide 82 to which the upper die 12 is fixed is suspended by a pressing cylinder 26, and is guided by a guide cylinder 27 so as not to laterally vibrate.

Similarly to the case of the lower die 11, an electrode storage space 12*a* is provided near each of right and left ends (right and left ends in FIG. 1) of the upper die 12. The forming device 10 is provided with a first electrode 17 and a second electrode 18 that are configured to advance or retreat in a vertical direction by an actuator (not shown) in the electrode storage space 12*a* as in the lower die 11. Recessed grooves 17*a* and 18*a* having a semi-arc shape corresponding to an outer peripheral surface on the upper side of the metal pipe material 14 are formed in lower surfaces of the first electrode 17 and the second electrode 18, respectively (see FIG. 3C), and the metal pipe material 14 can be well fitted in the recessed grooves 17*a* and 18*a*. In addition, in a front surface of the first electrode 17 (a surface of the die in an outward direction), a tapered recessed surface 17*b* is formed such that the vicinity thereof is recessed at an angle into a tapered shape toward the recessed groove 17*a*, and in a front surface of the second electrode 18 (a surface of the die in an outward direction), a tapered recessed surface 18*b* is formed such that the vicinity thereof is recessed at an angle into a tapered shape toward the recessed groove 13*a*. Accordingly, in a case where the pair of first and second electrodes 17 and 18 positioned in the upper die 12 also constitute the pipe holding mechanism 30 and the metal pipe material 14 is sandwiched between the pairs of upper and lower first and second electrodes 17 and 18 in the vertical direction, the metal pipe material 14 can be surrounded such that the outer periphery thereof firmly adheres well over the whole periphery.

The driving mechanism 80 is provided with the slide 82 that moves the upper die 12 so as to combine the upper die 12 and the lower die 11 together, a driving unit 81 that generates a driving force for moving the slide 82, and a servo motor 83 that controls a fluid amount with respect to the driving unit 81. The driving unit 81 is composed of a fluid supply unit that supplies a fluid (an operating oil in a case where a hydraulic cylinder is employed as the pressing cylinder 26) for driving the pressing cylinder 26 to the pressing cylinder 26.

The controller 70 can control the movement of the slide 82 by controlling the amount of the fluid to be supplied to the pressing cylinder 26 by controlling the servo motor 83 of the driving unit 81. The driving unit 81 is not limited to a unit that applies a driving force to the slide 82 via the pressing cylinder 26 as described above. For example, the driving unit 81 may directly or indirectly apply a driving force generated by the servo motor 83 to the slide 82 by mechanically connecting the driving mechanism to the slide 82. For example, a driving mechanism having an eccentric shaft, a driving source (for example, a servo motor and a reducer) that applies a rotating force for rotating the eccentric shaft, and a converter (for example, a connecting rod or an eccentric sleeve) that converts the rotational movement of the eccentric shaft into the linear movement to move the slide may be employed. In this embodiment, the driving unit 81 may not have the servo motor 83.

Figure 2:
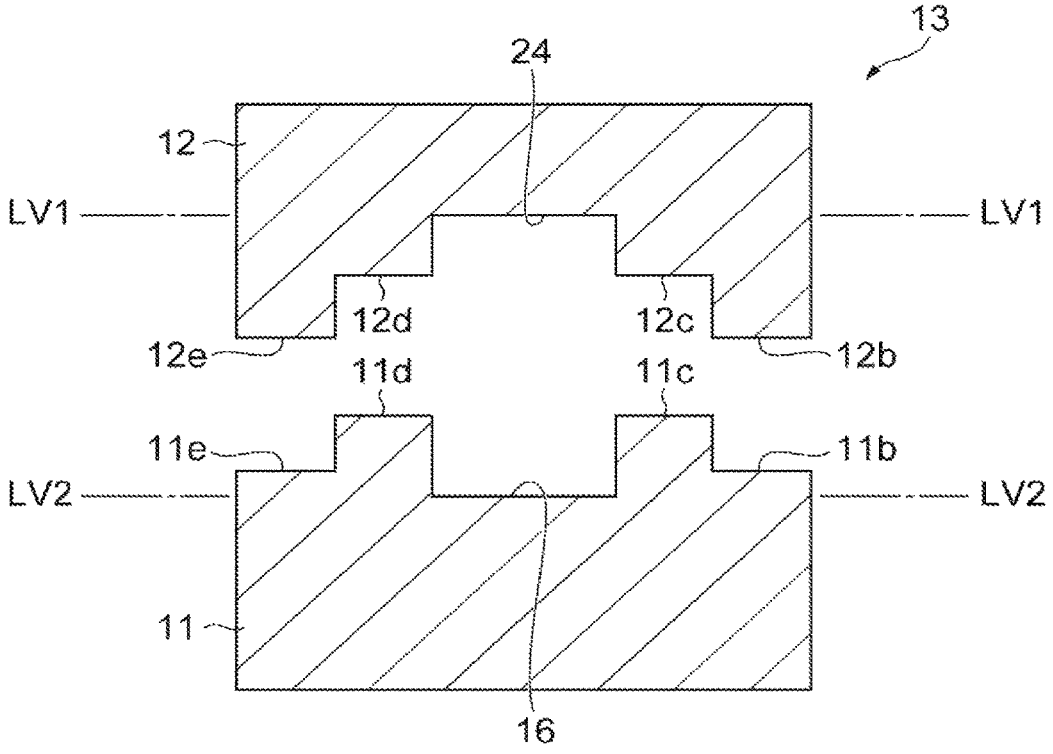
FIG. 2 is a cross-sectional view of a blow forming die taken along line II-II shown in FIG. 1.

FIG. 2 is a cross-sectional view of a blow forming die 13 taken along line II-II shown in FIG. 1. As shown in FIG. 2, steps are provided in all of the upper surface of the lower die 11 and the lower surface of the upper die 12.

The upper surface of the lower die 11 has steps formed by a first protrusion 11*b*, a second protrusion 11*c*, a third protrusion 11*d*, and a fourth protrusion 11*e* with a surface of the cavity 16 at the center of the lower die 11 as a reference line LV2. The first protrusion 11*b* and the second protrusion 11*c* are formed on the right side (on the right side in FIG. 2 and on the inner side in FIG. 1) of the cavity 16, and the third protrusion 11*d* and the fourth protrusion 11*e* are formed on the left side (on the left side in FIG. 2 and on the front side in FIG. 1) of the cavity 16. The second protrusion 11*c* is positioned between the cavity 16 and the first protrusion 11*b*. The third protrusion 11*d* is positioned between the cavity 16 and the fourth protrusion 11*e*. Each of the second protrusion 11*c* and the third protrusion 11*d* protrudes closer to the upper die 12 than the first protrusion 11*b* and the fourth protrusion 11*e*. The first protrusion 11*b* and the fourth protrusion 11*e* have substantially the same protrusion amount from the reference line LV2, and the second protrusion 11*c* and the third protrusion 11*d* have substantially the same protrusion amount from the reference line LV2.

The lower surface of the upper die 12 has steps formed by a first protrusion 12*b*, a second protrusion 12*c*, a third protrusion 12*d*, and a fourth protrusion 12*e* with a surface of the cavity 24 at the center of the upper die 12 as a reference line LV1. The first protrusion 12*b* and the second protrusion 12*c* are formed on the right side (on the right side in FIG. 2) of the cavity 24, and the third protrusion 12*d* and the fourth protrusion 12*e* are formed on the left side (on the left side in FIG. 2) of the cavity 24. The second protrusion 12*c* is positioned between the cavity 24 and the first protrusion 12*b*. The third protrusion 12*d* is positioned between the cavity 24 and the fourth protrusion 12*e*. Each of the first protrusion 12*b* and the fourth protrusion 12*e* protrudes closer to the lower die 11 than the second protrusion 12*c* and the third protrusion 12*d*. The first protrusion 12*b* and the fourth protrusion 12*e* have substantially the same protrusion amount from the reference line LV1, and the second protrusion 12*c* and the third protrusion 12*d* have substantially the same protrusion amount from the reference line LV1.

The first protrusion 12*b* of the upper die 12 is opposed to the first protrusion 11*b* of the lower die 11. The second protrusion 12*c* of the upper die 12 is opposed to the second protrusion 11*c* of the lower die 11. The cavity 24 of the upper die 12 is opposed to the cavity 16 of the lower die 11. The third protrusion 12*d* of the upper die 12 is opposed to the third protrusion 11*d* of the lower die 11. The fourth protrusion 12*e* of the upper die 12 is opposed to the fourth protrusion 11*e* of the lower die 11. A protrusion amount of the first protrusion 12*b* relative to the second protrusion 12*c* (a protrusion amount of the fourth protrusion 12*e* relative to the third protrusion 12*d*) in the upper die 12 is larger than a protrusion amount of the second protrusion 11*c* relative to the first protrusion 11*b* (a protrusion amount of the third protrusion 11*d* relative to the fourth protrusion 11*e*) in the lower die 11. Accordingly, between the second protrusion 12*c* of the upper die 12 and the second protrusion 11*c* of the lower die 11, and between the third protrusion 12*d* of the upper die 12 and the third protrusion 11*d* of the lower die 11, a space is formed (see FIG. 7C) when the upper die 12 and the lower die 11 are fitted together. In addition, between the cavity 24 of the upper die 12 and the cavity 16 of the lower die 11, a space is formed (see FIG. 7C) when the upper die 12 and the lower die 11 are fitted together.

Figure 7A:
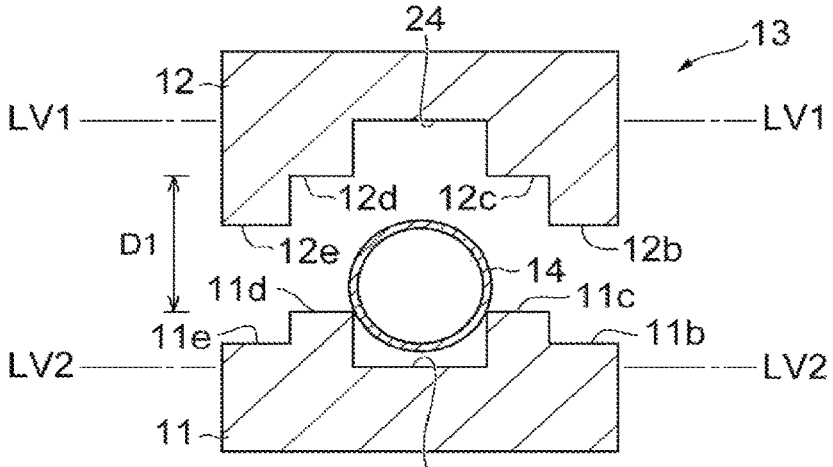
FIGS. 7A to 7D are diagrams showing operations of the blow forming die and a change in the shape of a metal pipe material.
Figure 7B:
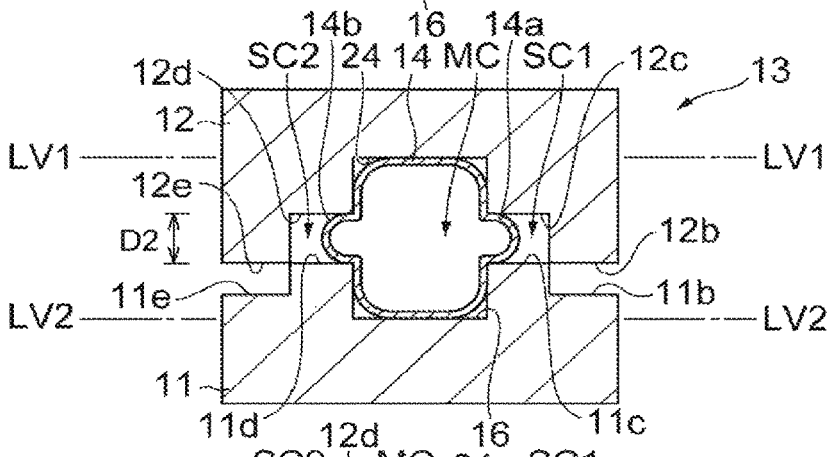

More specifically, at a point of time before the lower die 11 and the upper die 12 are combined and fitted together during blow forming, as shown in FIG. 7B, a main cavity part (first cavity part) MC is formed between the surface (the surface as the reference line LV1) of the cavity 24 of the upper die 12 and the surface (the surface as the reference line LV2) of the cavity 16 of the lower die 11. A sub-cavity part (second cavity part) SC1 that communicates with the main cavity part MC and has a smaller volume than the main cavity part MC is formed between the second protrusion 12*c* of the upper die 12 and the second protrusion 11*c* of the lower die 11. Similarly, a sub-cavity part (second cavity part) SC2 that communicates with the main cavity part MC and has a smaller volume than the main cavity part MC is formed between the third protrusion 12*d* of the upper die 12 and the third protrusion 11*d* of the lower die 11. The main cavity part MC is a part that forms a pipe part 100*a* of a metal pipe 100, and the sub-cavity parts SC1 and SC2 are parts that form flange parts 100*b* and 100*c* of the metal pipe 100 (see FIGS. 7C and 7D), respectively. In a case where the lower die 11 and the upper die 12 are combined together and completely closed (fitted), the main cavity part MC and the sub-cavity parts SC1 and SC2 are sealed in the lower die 11 and the upper die 12.

As shown in FIG. 1, the heating mechanism 50 has a power supply 51, conductive wires 52 that extend from the power supply 51 and are connected to the first electrodes 17 and the second electrodes 18, and a switch 53 that is provided on the conductive wire 52. The controller 70 can heat the metal pipe material 14 to a quenching temperature (equal to or higher than an AC3 transformation temperature) by controlling the heating mechanism 50.

Figure 3A:
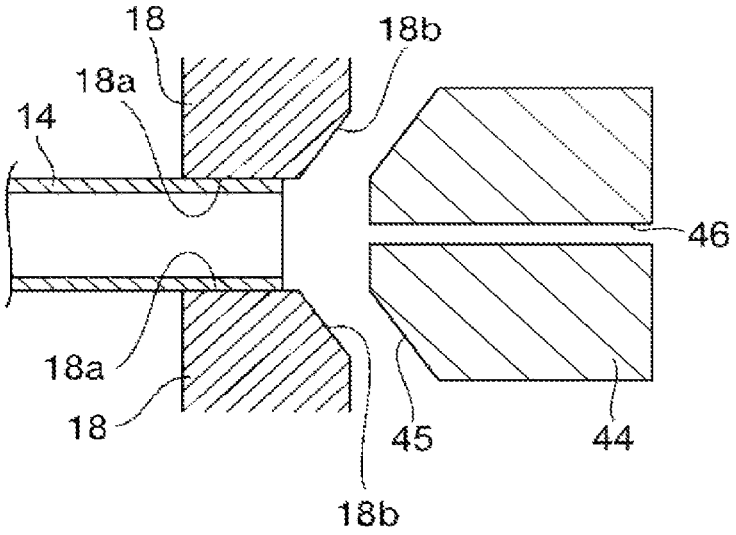
FIGS. 3A to 3C are enlarged views of the vicinity of electrodes.
Figure 3B:
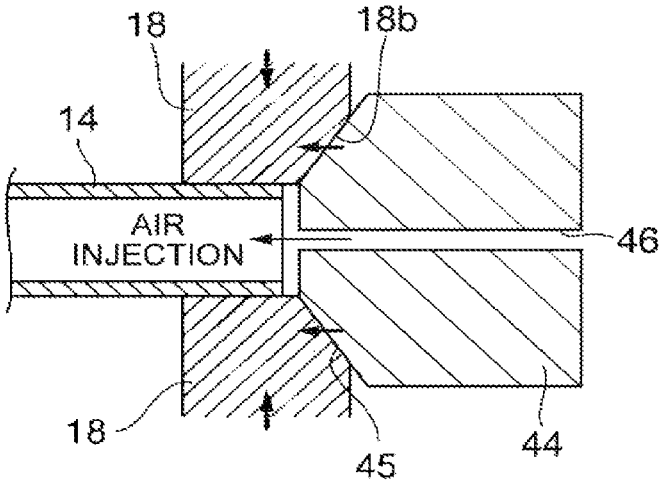
Figure 3C:
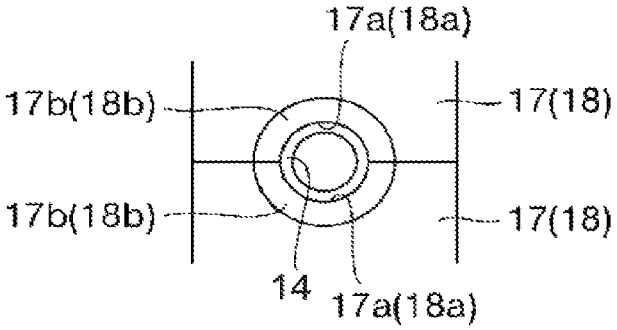

Each of the pair of gas supply mechanisms 40 has a cylinder unit 42, a cylinder rod 43 that advances or retreats in accordance with the operation of the cylinder unit 42, and a sealing member 44 that is connected to a tip end of the cylinder rod 43 on the side of the pipe holding mechanism 30. The cylinder unit 42 is placed and fixed on the base 15 via a block 41. A tapered surface 45 is formed at a tip end of each sealing member 44 so as to be tapered. One tapered surface 45 is formed into such a shape as to be well fitted in and brought into contact with the tapered recessed surface 17*b* of the first electrode 17, and the other tapered surface 45 is formed into such a shape as to be well fitted in and brought into contact with the tapered recessed surface 18*b* of the second electrode 18 (see FIGS. 3A to 3C). The sealing member 44 extends from the cylinder unit 42 to the tip end. Specifically, as shown in FIGS. 3A and 3B, a gas passage 46 through which a high-pressure gas supplied from the gas supply part 60 flows is provided.

The gas supply part 60 includes a gas supply 61, an accumulator 62 that stores a gas supplied by the gas supply 61, a first tube 63 that extends from the accumulator 62 to the cylinder unit 42 of the gas supply mechanism 40, a pressure control valve 64 and a switching valve 65 that are provided in the first tube 63, a second tube 67 that extends from the accumulator 62 to the gas passage 46 formed in the sealing member 44, and a pressure control valve 68 and a check valve 69 that are provided in the second tube 67. The pressure control valve 64 functions to supply, to the cylinder unit 42, a gas at an operation pressure adapted for the pressing force of the sealing member 44 with respect to the metal pipe material 14. The check valve 69 functions to prevent the high-pressure gas from flowing backward in the second tube 67.

The pressure control valve 68 provided in the second tube 67 functions to supply a gas having an operation pressure for expanding parts 14*a* and 14*b* (see FIG. 7B) of the metal pipe material 14 (hereinafter, referred to as low-pressure gas) and a gas having an operation pressure for forming a pipe part 100*a* (see FIG. 7D) of the metal pipe 100 (hereinafter, referred to as high-pressure gas) to the gas passage 46 of the sealing member 44 by the control of the controller 70. In other words, the controller 70 can supply a gas having a desired operation pressure into the metal pipe material 14 by controlling the pressure control valve 68 of the gas supply part 60. The pressure of the high-pressure gas is, for example, approximately two to five times the pressure of the low-pressure gas.

The controller 70 acquires temperature information from the thermocouple 21 by information transmission from (A) shown in FIG. 1, and controls the pressing cylinder 26 and the switch 53. The water circulation mechanism 72 includes a water tank 73 that stores water, a water pump 74 that draws up and pressurizes the water stored in the water tank 73 to send the water to the cooling water passage 19 of the lower die 11 and the cooling water passage 25 of the upper die 12, and a pipe 75. Although omitted, a cooling tower that lowers the water temperature or a filter that purifies the water may be provided in the pipe 75.

Method for Forming Metal Pipe Using Forming Device

Figure 4A:
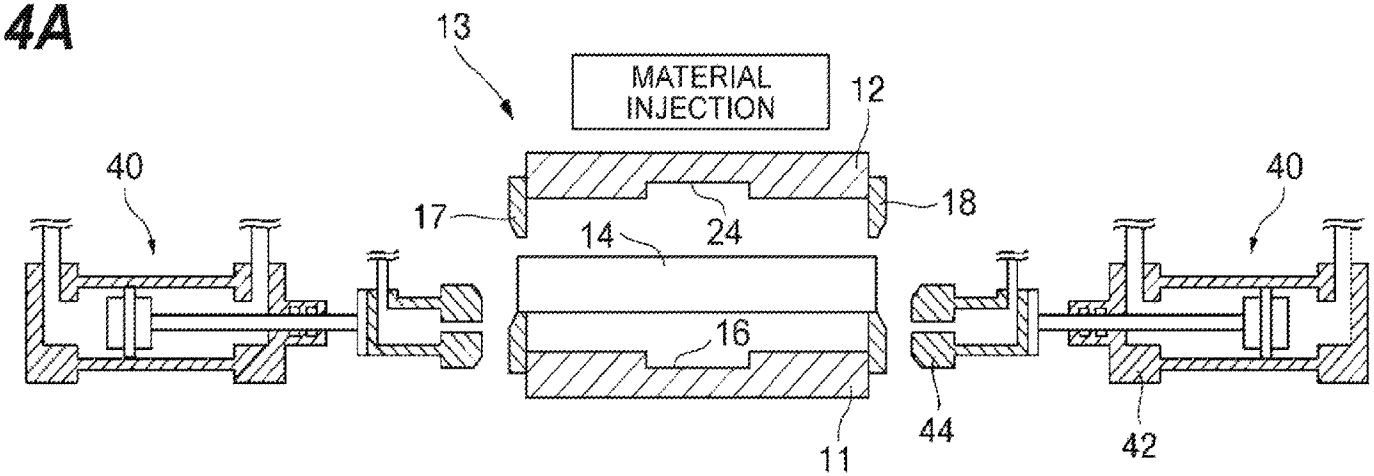
FIGS. 4A and 4B are diagrams showing a manufacturing step using the forming device.
Figure 4B:
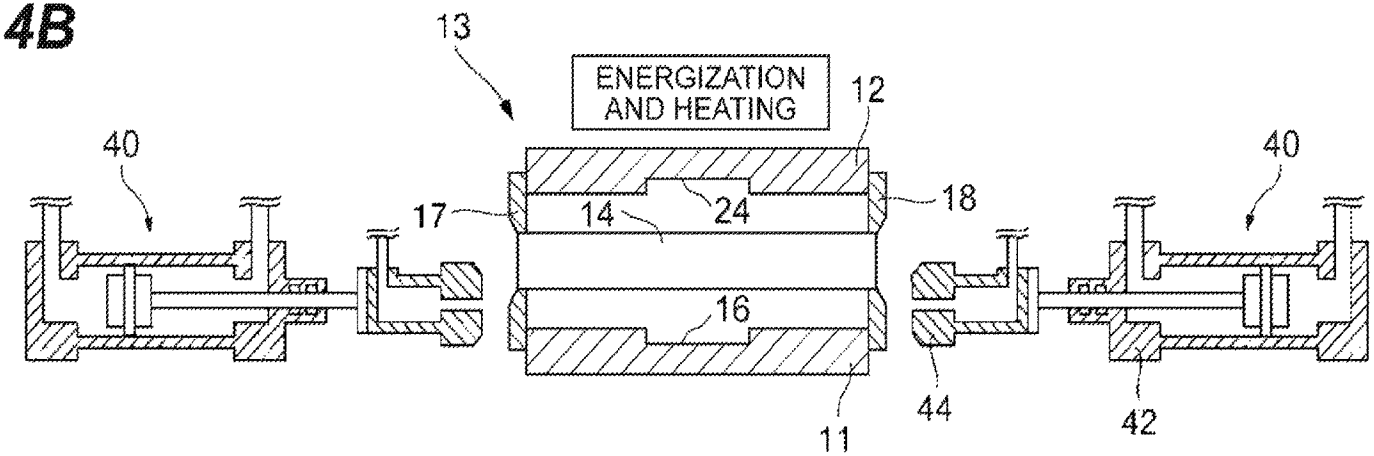

Next, a method for forming a metal pipe using the forming device 10 will be described. FIGS. 4A and 4B show steps from a pipe injection step for injecting the metal pipe material 14 as a material to an energization and heating step for heating the metal pipe material 14 by energization. First, a metal pipe material 14 that is a quenchable steel type is prepared. As shown in FIG. 4A, the metal pipe material 14 is placed (injected) on the first and second electrodes 17 and 18 provided in the lower die 11 using, for example, a robot arm or the like. Since the first and second electrodes 17 and 18 have the recessed grooves 17*a* and 18*a*, respectively, the metal pipe material 14 is positioned by the recessed grooves 17*a* and 18*a*. Next, the controller 70 (see FIG. 1) controls the pipe holding mechanism 30 to hold the metal pipe material 14 by the pipe holding mechanism 30. Specifically, as in FIG. 4B, an actuator that allows the first and second electrodes 17 and 18 to advance or retreat is operated such that the first and second electrodes 17 and 18 positioned on the upper and lower sides, respectively, are brought closer to and into contact with each other. Due to this contact, both of the end parts of the metal pipe material 14 are sandwiched between the first and second electrodes 17 and 18 from the upper and lower sides. In addition, due to the presence of the recessed grooves 17*a* and 18*a* formed in the first and second electrodes 17 and 18, the metal pipe material 14 is sandwiched so as to firmly adhere over the whole periphery thereof. However, the invention is not limited to the configuration in which the metal pipe material 14 firmly adheres over the whole periphery thereof, and may have a configuration in which the first and second electrodes 17 and 18 are brought into contact with a part of the metal pipe material 14 in a peripheral direction.

Next, as shown in FIG. 1, the controller 70 controls the heating mechanism 50 to heat the metal pipe material 14. Specifically, the controller 70 turns on the switch 53 of the heating mechanism 50. After that, electric power is supplied from the power supply 51 to the metal pipe material 14, and the metal pipe material 14 produces heat (Joule heat) due to the resistance present in the metal pipe material 14. In this case, the measurement value of the thermocouple 21 is monitored always, and based on the results thereof, the energization is controlled.

Figure 5:
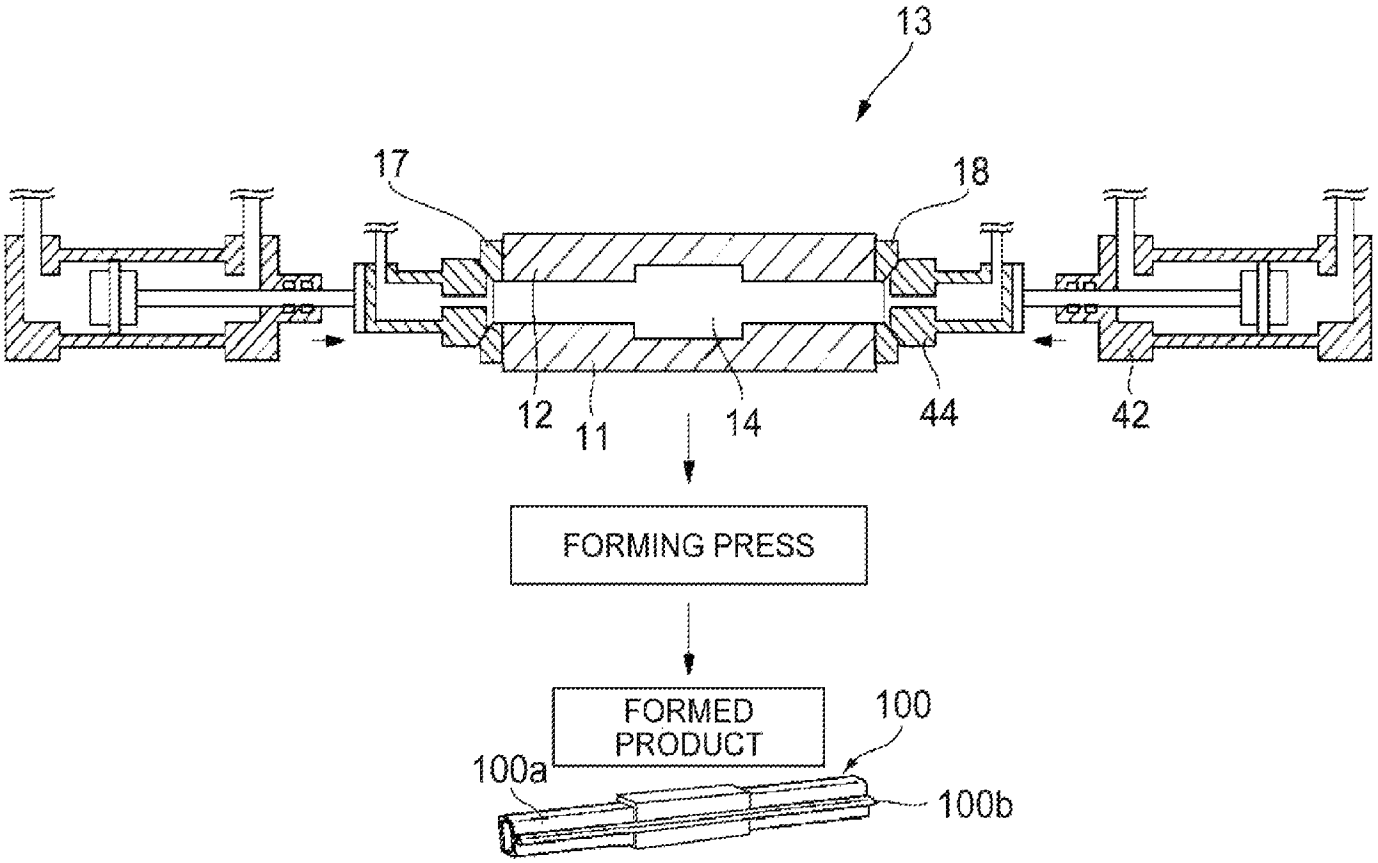
FIG. 5 is a diagram showing an outline of a blow forming step using the forming device and a flow thereafter.

FIG. 5 shows an outline of a blow forming step using the forming device and a flow thereafter. As shown in FIG. 5, the blow forming die 13 is closed with respect to the metal pipe material 14 after heating to dispose and seal the metal pipe material 14 in the cavity of the blow forming die 13. Then, the cylinder unit 42 of the gas supply mechanism 40 is operated to seal both ends of the metal pipe material 14 by the sealing member 44 (see FIGS. 3A to 3C as well). After completion of the sealing, the blow forming die 13 is closed and a gas is allowed to flow into the metal pipe material 14 to form the metal pipe material 14 softened by heating along the shape of the cavity (the method of forming the metal pipe material 14 will be described later in detail).

Since the metal pipe material 14 is softened by being heated at a high temperature (about 950° C.), the gas supplied into the metal pipe material 14 is thermally expanded. Therefore, for example, compressed air is used as a gas to be supplied, the metal pipe material 14 at 950° C. is easily expanded by thermally expanded compressed air, and thus the metal pipe 100 can be obtained.

Quenching is performed in such a way that the outer peripheral surface of the metal pipe material 14 expanded by being subjected to the blow forming is brought into contact with the cavity 16 of the lower die 11 so as to be rapidly cooled, and simultaneously, brought into contact with the cavity 24 of the upper die 12 so as to be rapidly cooled (since the upper die 12 and the lower die 11 have a large heat capacity and are managed at a low temperature, the heat of the pipe surface is taken to the dies at once in a case where the metal pipe material 14 are brought into contact with the dies). Such a cooling method is referred to as die contact cooling or die cooling. Immediately after the rapid cooling, the austenite is transformed to martensite (hereinafter, transformation of austenite to martensite will be referred to as martensite transformation). Since the cooling rate is low in the second half of the cooling, the martensite is transformed to another structure (troostite, sorbate, or the like) owing to recuperation. Therefore, there is no need to perform a separate tempering treatment. In this embodiment, in place of or in addition to the die cooling, a cooling medium may be supplied to the metal pipe 100 to perform cooling. For example, the metal pipe material 14 may be brought into contact with the die (upper die 12 and lower die 11) to be cooled until the temperature is lowered to a temperature at which the martensite transformation starts, and then, the die may be opened and a cooling medium (gas for cooling) may be allowed to flow to the metal pipe material 14 to cause the martensite transformation.

Figure 6:
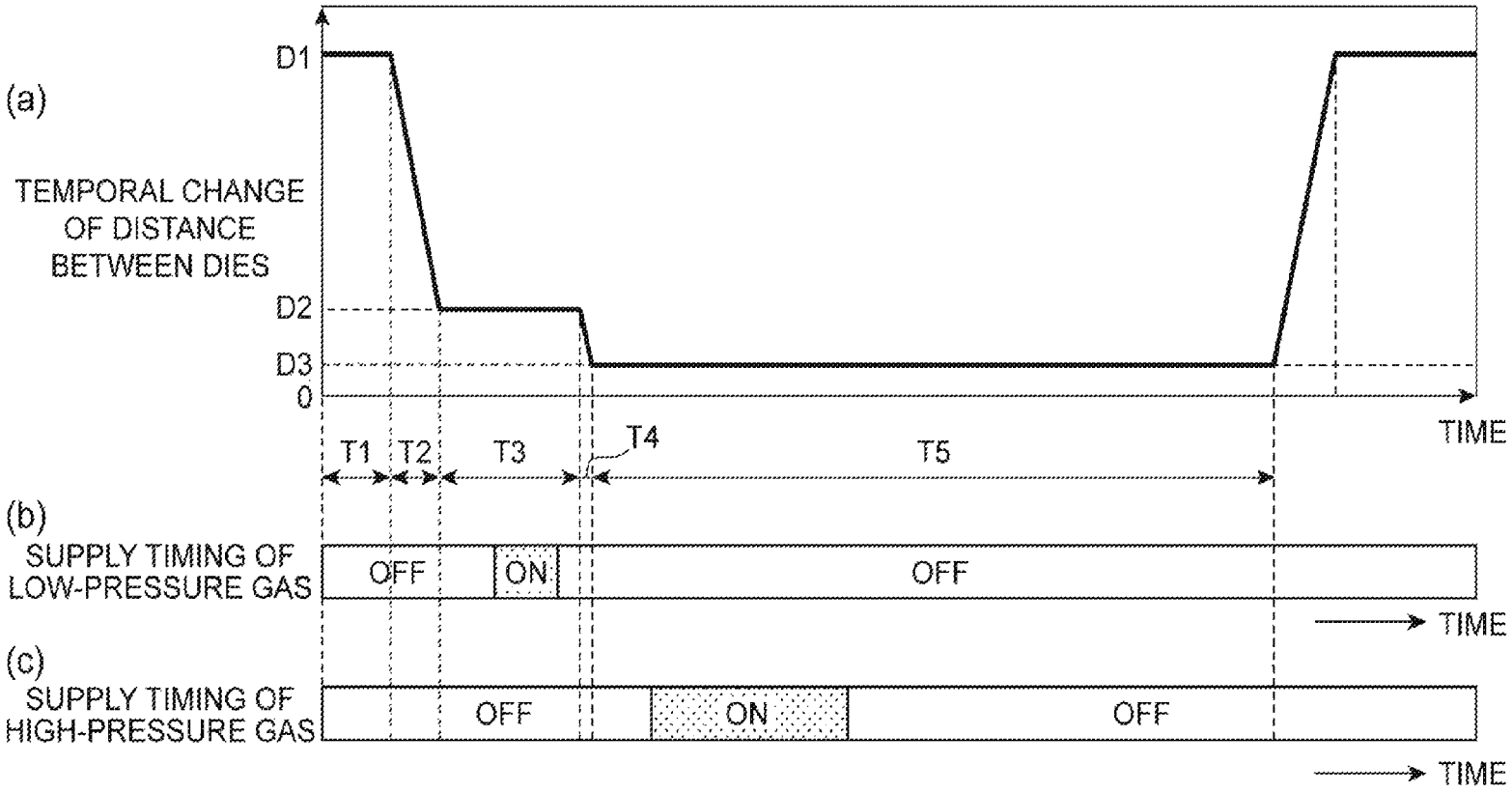
FIG. 6 is a timing chart of the blow forming step using the forming device.

Next, an example of specific forming using the upper die 12 and the lower die 11 will be described in detail with reference to FIGS. 6 and 7A to 7D. FIG. 6 is a timing chart of a blow forming step using the forming device. In FIG. 6, (a) of FIG. 6 shows a temporal change of the distance between the second protrusion 12*c* of the upper die 12 and the second protrusion 11*c* of the lower die 11. (b) of FIG. 6 shows a supply timing of a low-pressure gas. (c) of FIG. 6 shows a supply timing of a high-pressure gas. As shown in FIGS. 6 and 7A, a heated metal pipe material 14 is prepared between the cavity 24 of the upper die 12 and the cavity 16 of the lower die 11 during a period of time T1 of FIG. 6. For example, a metal pipe material 14 is supported by the second protrusion 11*c* and the third protrusion 11*d* of the lower die 11. The distance between the second protrusion 12*c* of the upper die 12 and the second protrusion 11*c* of the lower die 11 during the period of time T1 is D1.

Next, during a period of time T2 after the period of time T1 shown in FIG. 6, the upper die 12 is moved by the driving mechanism 80 in such a direction as to combine with the lower die 11. Accordingly, during a period of time T3 after the period of time T2 shown in FIG. 6, the upper die 12 and the lower die 11 are not completely closed as shown in FIG. 7B, and the distance between the second protrusion 12*c* of the upper die 12 and the second protrusion 11*c* of the lower die 11 is D2 (D2<D1). Accordingly, a main cavity part MC is formed between a surface of the cavity 24 on the reference line LV1 and a surface of the cavity 16 on the reference line LV2. In addition, a sub-cavity part SC1 is formed between the second protrusion 12*c* of the upper die 12 and the second protrusion 11*c* of the lower die 11, and a sub-cavity part SC2 is formed between the third protrusion 12*d* of the upper die 12 and the third protrusion 11*d* of the lower die 11. The main cavity part MC and the sub-cavity parts SC1 and SC2 communicate with each other. In this case, an inner edge of the first protrusion 12*b* of the upper die 12 and an outer edge of the second protrusion 11*c* of the lower die 11 are brought into contact with and firmly adhered to each other, an inner edge of the fourth protrusion 12*e* of the upper die 12 and an outer edge of the third protrusion 11*d* of the lower die 11 are brought into contact with and firmly adhered to each other, and the main cavity part MC and the sub-cavity parts SC1 and SC2 are sealed from the outside. In addition, a space (gap) is provided between the first protrusion 12*b* of the upper die 12 and the first protrusion 11*b* of the lower die 11, and between the fourth protrusion 12*e* of the upper die 12 and the fourth protrusion 11*e* of the lower die 11.

In addition, during the period of time T3, the gas supply part 60 supplies a low-pressure gas into the metal pipe material 14 softened by being heated by the heating mechanism 50. The pressure of this low-pressure gas is controlled using the pressure control valve 68 of the gas supply part 60, and is lower than a pressure of a high-pressure gas to be supplied into the metal pipe material 14 during a period of time T5 to be described later. Due to the supply of the low-pressure gas, the metal pipe material 14 is expanded in the main cavity part MC as shown in FIG. 7B. Parts (both side parts) 14*a* and 14*b* of the metal pipe material 14 are expanded so as to enter into the sub-cavity parts SC1 and SC2 communicating with the main cavity part MC, respectively, and the supply of the low-pressure gas is stopped.

Figure 7C:
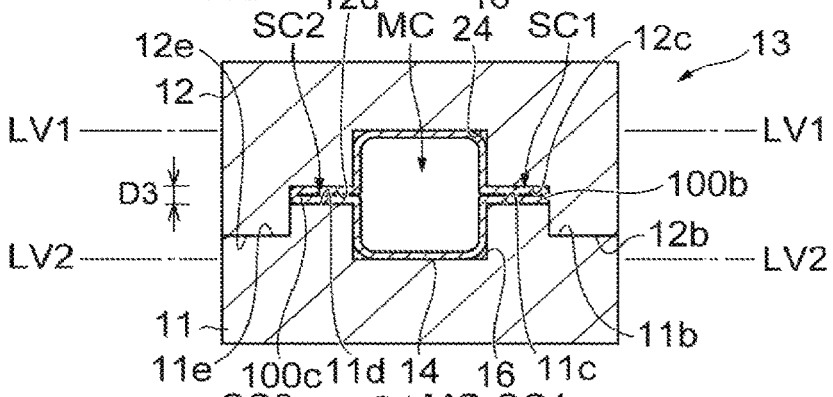

Next, the driving mechanism 80 moves the upper die 12 during a period of time T4 after the period of time T3 shown in FIG. 6. Specifically, the driving mechanism 80 moves the upper die 12 to fit (clamp) the upper die 12 and the lower die 11 together such that the distance between the second protrusion 12*c* of the upper die 12 and the second protrusion 11*c* of the lower die 11 is D3 (D3<D2) as shown in FIG. 7C. In this case, the first protrusion 12*b* of the upper die 12 and the first protrusion 11*b* of the lower die 11 are firmly adhered to each other with no gap, and the fourth protrusion 12*e* of the upper die 12 and the fourth protrusion 11*e* of the lower die 11 are firmly adhered to each other with no gap. Due to the driving of the driving mechanism 80, the expanded parts 14*a* and 14*b* of the metal pipe material 14 are pressed by the upper die 12 and the lower die 11, a flange part 100*b* of a metal pipe 100 is formed in the sub-cavity part SC1, and a flange part 100*c* of the metal pipe 100 is formed in the sub-cavity part SC2. Each of the flange parts 100*b* and 100*c* is formed in such a way that a part of the metal pipe material 14 is folded along the longitudinal direction of the metal pipe 100 (see FIG. 5).

Figure 7D:
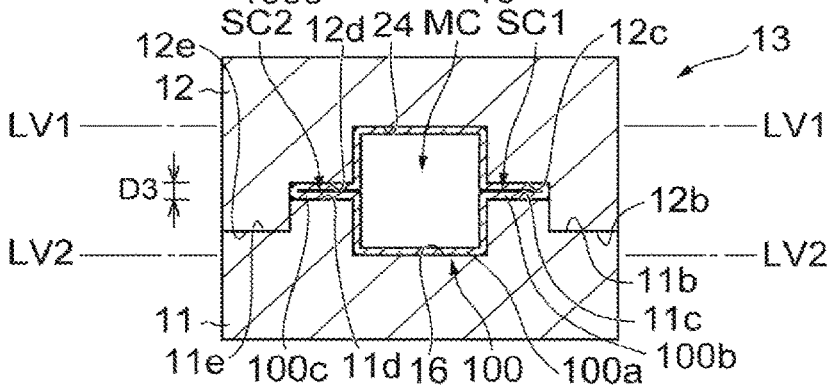

Next, during a period of time T5 after the period of time T4 shown in FIG. 6, the gas supply part 60 supplies a high-pressure gas into the metal pipe material 14 after the formation of the flange parts 100*b* and 100*c*. The pressure of this high-pressure gas is controlled using the pressure control valve 68 of the gas supply part 60. Due to the supply of the high-pressure gas, the metal pipe material 14 in the main cavity part MC is expanded and a pipe part 100*a* of the metal pipe 100 is formed as shown in FIG. 7D. The supply time of the high-pressure gas during the period of time T5 is longer than the supply time of the low-pressure gas during the period of time T3. Accordingly, the metal pipe material 14 is sufficiently expanded and distributed throughout the main cavity part MC, and the pipe part 100*a* is formed along the shape of the main cavity part MC defined by the upper die 12 and the lower die 11.

When the above-described period of times T1 to T5 have passed, it is possible to complete a metal pipe 100 having a pipe part 100*a* and flange parts 100*b* and 100*c*. The period of time from the blow formation of the metal pipe material 14 to the completion of the formation of the metal pipe 100 is about several seconds to several tens of seconds, although depending on the type of the metal pipe material 14. In the example shown in FIG. 7D, the main cavity part MC is configured to have a rectangular cross-sectional shape. Accordingly, by subjecting the metal pipe material 14 to blow forming in accordance with the shape, the pipe part 100*a* is formed into a rectangular tube shape. However, the shape of the main cavity part MC is not particularly limited, and all shapes such as an annular cross-sectional shape, an elliptical cross-sectional shape, and a polygonal cross-sectional shape may be employed in accordance with a desired shape.

Next, the forming device 10 according to this embodiment, and actions and effects of the forming method using the forming device 10 will be described compared to comparative examples.

Figure 8A:
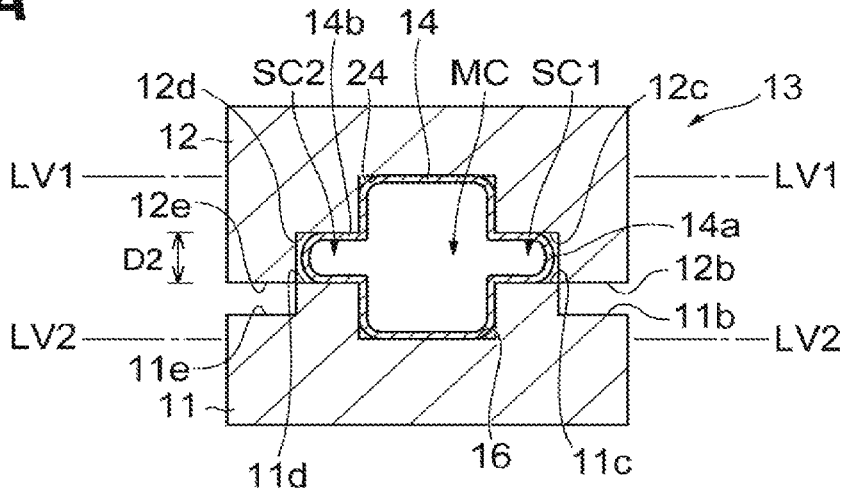
FIGS. 8A and 8B are diagrams showing operations of a blow forming die according to a comparative example and a change in the shape of a metal pipe material.
Figure 8B:
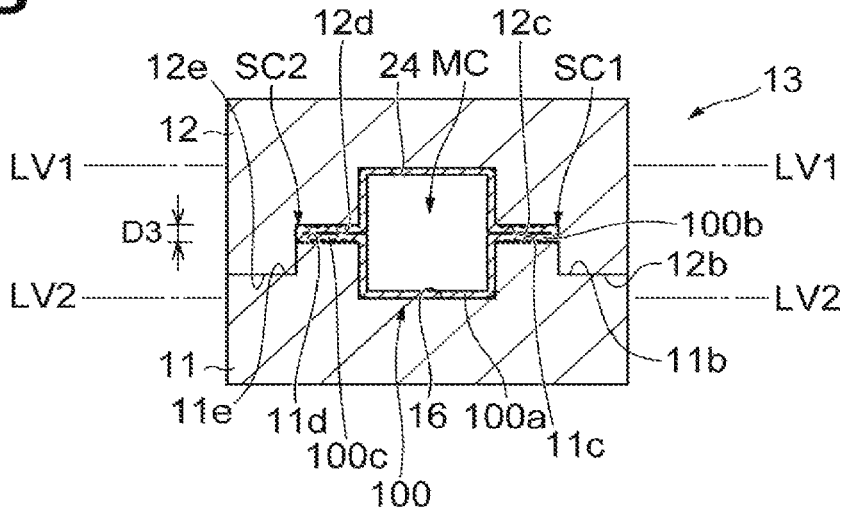

First, a forming method using a forming device according to a comparative example will be described with reference to FIGS. 8A and 8B. A controller of the forming device according to the comparative example controls driving of a driving mechanism so as to combine dies together, while controlling a gas supply part so as to supply only a high-pressure gas. Accordingly, in the forming method using the forming device according to the comparative example, a gas to be supplied to a metal pipe material 14 is a high-pressure gas, and driving is performed such that an upper die 12 combines with a lower die 11 simultaneously with the supply of a high-pressure gas to the metal pipe material 14. In this case, as shown in FIG. 8A, parts 14*a* and 14*b* of the metal pipe material 14 expanded so as to enter into sub-cavity parts SC1 and SC2, respectively, are larger than those in the forming method according to this embodiment. When the parts 14*a* and 14*b* of the metal pipe material 14 expanded excessively are pressed by the upper die 12 and the lower die 11, bending, distortion, folding, or the like occurs on flange parts 100*b* and 100*c* as shown in FIG. 8B, and thus there is a problem in that a flange part having a desired shape cannot be obtained. In addition, in accordance with the supply time of the high-pressure gas, the elongation rate of the metal pipe material 14 exceeds a limit, and there is a concern that the metal pipe material 14 may break.

According to the forming device 10 according to this embodiment, by the control of the controller 70, a gas can be supplied into the metal pipe material 14 from the gas supply part 60 so as to expand parts 14*a* and 14*b* of the metal pipe material 14 in the sub-cavity parts SC1 and SC2, and then the driving mechanism 80 can be driven such that the expanded parts 14*a* and 14*b* of the metal pipe material 14 are pressed by the upper die 12 and the lower die 11 to form flange parts 100*b* and 100*c*. In addition, by the control of the controller 70, a gas can be supplied into the metal pipe material 14 after the formation of the flange parts 100*b* and 100*c* from the gas supply part 60 so as to form a pipe part 100*a* in the main cavity part MC. In this manner, the controller 70 controls the gas supply part 60 and the driving mechanism 80 so as to separately form the flange parts 100*b* and 100*c* and the pipe part 100*a* of a metal pipe 100, and thus flange parts 100*b* and 100*c* and a pipe part 100*a* having a desired shape can be easily formed.

In addition, in this embodiment, the pressure of the low-pressure gas when parts 14*a* and 14*b* of the metal pipe material 14 are expanded in the sub-cavity parts SC1 and SC2 is made lower than the pressure of the high-pressure gas when a pipe part 100*a* is formed in the main cavity part MC. Accordingly, flange parts 100*b* and 100*c* can be formed into a desired size with the low-pressure gas, and a pipe part 100*a* having a desired shape can be formed with the high-pressure gas regardless of the flange parts 100*b* and 100*c*. Therefore, flange parts 100*b* and 100*c* and a pipe part 100*a* having a desired shape can be more easily formed.

Although preferable embodiments of an aspect of the invention have been described, the invention is not limited to the above-described embodiments. For example, the forming device 10 in the above-described embodiment may not essentially have the heating mechanism 50, and the metal pipe material 14 may be heated already.

The driving mechanism 80 according to this embodiment moves only the upper die 12. However, the driving mechanism may move the lower die 11 in addition to or in place of the upper die 12. In a case where the lower die 11 is moved, the lower die 11 is not fixed to the base 15, but is attached to the slide of the driving mechanism 80.

The gas supply 61 according to this embodiment may have both of a high-pressure gas supply for supplying a high-pressure gas and a low-pressure gas supply for supplying a low-pressure gas. In this case, a gas may be supplied to the gas supply mechanism 40 from the high-pressure gas supply or the low-pressure gas supply in accordance with the situation by controlling the gas supply 61 of the gas supply part 60 by the controller 70. In a case where the gas supply 61 has a high-pressure gas supply or a low-pressure gas supply, the pressure control valve 68 may be included in the gas supply part 60.

The metal pipe 100 according to this embodiment may have a flange part at one side thereof. In this case, one sub-cavity part is formed by the upper die 12 and the lower die 11.

The metal pipe material 14 that is prepared between the upper die 12 and the lower die 11 may have an elliptical cross-sectional shape in which a diameter in a horizontal direction is longer than a diameter in a vertical direction. Accordingly, a part of the metal pipe material 14 may be allowed to easily enter into the sub-cavity parts SC1 and SC2. In addition, the metal pipe material 14 may be previously subjected to bending (pre-bending) along an axial direction. In this case, the formed metal pipe 100 has a flange part and formed into a bent tube shape.

It should be understood that the invention is not limited to the above-described embodiment, but may be modified into various forms on the basis of the spirit of the invention. Additionally, the modifications are included in the scope of the invention.

What is claimed is:

1. A forming device configured to form a metal pipe having a pipe part and a flange part, the forming device comprising:

a pair of a first die and a second die;

a driving mechanism configured to move at least one of the first die and the second die in a direction in which the dies are approached together;

a gas supply part configured to supply a first gas and a second gas into a metal pipe material held and heated between the first die and the second die; and a controller configured to control driving of the driving mechanism and gas supply of the gas supply part, wherein the first die and the second die configure a first cavity part for forming the pipe part and a second cavity part, communicating with the first cavity part, for forming the flange part, and the controller is configured to:

cause the gas supply part to supply a first gas into the metal pipe material during a first supply time, such that a part of the metal pipe material is expanded in the second cavity part;

drive the driving mechanism such that the expanded part of the metal pipe material is pressed by the first die and the second die and the flange part is formed; and cause the gas supply part to supply a second gas into the metal pipe material during a second supply time, after the formation of the flange part such that the pipe part is formed in the first cavity part, and wherein the second supply time is longer than the first supply time.

2. The forming device according to claim 1, wherein a pressure of the first gas when a part of the metal pipe material is expanded in the second cavity part is lower than a pressure of the second gas when the pipe part is formed in the first cavity part.

3. A forming method for forming a metal pipe having a pipe part and a flange part, the forming method comprising:

preparing a heated metal pipe material between a first die and a second die;

moving at least one of the first die and the second die in a direction in which the dies are approached together to form a first cavity part for forming the pipe part and a second cavity part, communicating with the first cavity part, for forming the flange part between the first die and the second die;

supplying a first gas into the metal pipe material by a gas supply part to expand a part of the metal pipe material in the second cavity part during a first supply time;

moving at least one of the first die and the second die in the direction to press the expanded part of the metal pipe material by the first die and the second die and form the flange part; and supplying a second gas into the metal pipe material after the formation of the flange part by the gas supply part to form the pipe part in the first cavity part during a second supply time, wherein the second supply time is longer than the first supply time.

4. The forming method according to claim 3, wherein a pressure of the first gas when a part of the metal pipe material is expanded in the second cavity part is lower than a pressure of the second gas when the pipe part is formed in the first cavity part.

* * * * *